US007543638B2

(12) United States Patent
Goodman

(10) Patent No.: US 7,543,638 B2
(45) Date of Patent: Jun. 9, 2009

(54) LOW TEMPERATURE OXIDATION FOR ENHANCED OIL RECOVERY

(75) Inventor: Kenneth R. Goodman, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 60 days.

(21) Appl. No.: 11/308,599

(22) Filed: Apr. 10, 2006

(65) Prior Publication Data

US 2007/0235187 A1 Oct. 11, 2007

(51) Int. Cl.
*E21B 43/26* (2006.01)

(52) U.S. Cl. ..... 166/259; 166/260; 166/262; 166/280.1

(58) Field of Classification Search ..... None
See application file for complete search history.

(56) References Cited

U.S. PATENT DOCUMENTS 3,712,375 A * 1/1973 Berry et al. ..... 166/250.15
3,948,754 A * 4/1976 McCollum et al. ..... 208/391
3,968,024 A * 7/1976 Gorring et al. ..... 208/111.15
4,148,358 A * 4/1979 Compton ..... 166/256
4,437,519 A * 3/1984 Cha et al. ..... 166/259
5,482,118 A * 1/1996 Clough ..... 166/279
5,899,269 A 5/1999 Wellington
6,910,536 B2 6/2005 Wellington
6,918,442 B2 7/2005 Wellington
6,966,372 B2 11/2005 Wellington
6,991,033 B2 1/2006 Wellington
2002/0026000 A1* 2/2002 Varadaraj ..... 524/129
2002/0148608 A1* 10/2002 Shaw ..... 166/251.1
2007/0137858 A1* 6/2007 Considine et al. ..... 166/248

OTHER PUBLICATIONS

Hu, Zhiyu, et al. "Nanocatalytic Spontaneous Ignition and Self-Supporting Room-Temperature Combustion," Dec. 14, 2004, Energy & Fuels 2005, 19, p. 855-858.*

(Continued)

*Primary Examiner*—Zakiya W Bates
*Assistant Examiner*—Angela M DiTrani
(74) *Attorney, Agent, or Firm*—Osha • Liang LLP; Kevin B. McGoff; James L. Kurka

(57) ABSTRACT

Methods and systems for enhancing oil recovery are disclosed. A method for enhancing oil recovery in a formation includes placing a catalyst in a wellbore; and introducing an oxidizing agent into the wellbore to contact the catalyst such that a hydrocarbon in the formation is oxidized to produce heat and at least one gas. A system for enhancing oil recovery in a reservoir formation includes a catalyst arranged within a well adjacent the reservoir formation; and an oxidizing agent for engaging the catalyst, the oxidizing agent adapted to generate heat and at least one gas when engaging the catalyst and oxidizing a hydrocarbon. The oxidizing agent may be air or oxygen. The catalyst may be one selected from platinum, palladium, rhodium, ruthenium, lead, manganese, nickel and metal oxides thereof. Further, the catalyst may be in the form of nanoparticles.

18 Claims, 1 Drawing Sheet

OTHER PUBLICATIONS

Nanoparticle—Wikepedia, the free encyclopedia, retrieved Oct. 9, 2007 from http://en.wikepedia.org/w/index.php?title=Nanoparticle &printable=yes; dated from Jan. 26, 2005.*

Mesh to Micron Conversion Chart—FLUIDENG.com, retrieved Jan. 2, 2008 from http://www.fluideng.com/FE/meshmicron.html.*

Hu, Zhiyu; Boiadjiev, Vassil; Thundat, Thomas; "Nanocatalytic Spontaneous Ignition and Self-Supporting Room-Temperature Combustion"; Energy & Fuels 2005; Apr. 15, 2005; pp. 855-858; American Chemical Society.

* cited by examiner

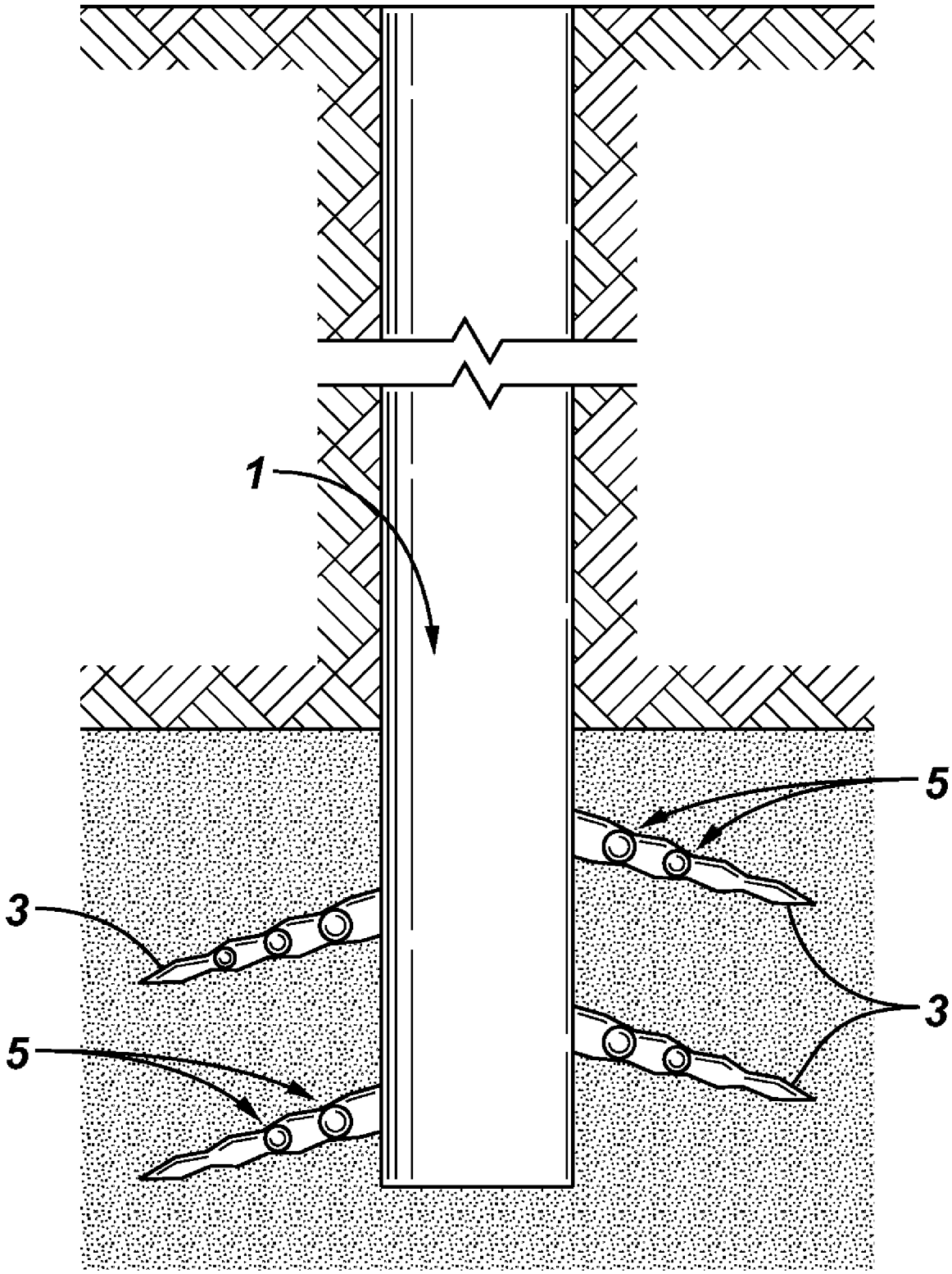
1
5
3
3
5

LOW TEMPERATURE OXIDATION FOR ENHANCED OIL RECOVERY

BACKGROUND OF INVENTION

1. Field of the Invention

The present invention relates generally to methods for enhancing the recovery of oil.

2. Background Art

Hydrocarbons obtained from subterranean (e.g., sedimentary) formations are often used as energy resources, as feedstocks, and as consumer products. There are three stages of oil recovery from a formation. When oil wells are first drilled, the oil may flow up freely under its own pressure. At such primary recovery stage, oil and gas are produced using the natural pressure of the reservoir as the driving force to push the material to the surface.

At some point, the in situ pressure will decrease and the spontaneous production of hydrocarbons will cease, leading to the secondary recovery stage. When this happens, wells may need to be "stimulated." Methods for well stimulation may include gas/fluid injection and water flooding, to produce residual oil and gas remaining after the primary recovery phase. U.S. Pat. No. 6,966,374 issued to Vinegar et al. discloses a method of using gas to increase the mobility of hydrocarbons in a formation.

Carbon dioxide is commonly used in gas injection. Pressurized CO2 has physical properties that enable it to extract hard-to-get oil trapped in an oil field's porous rock after the first stage of crude oil production. In this process, compressors inject CO2 into the oil reservoir, where the remaining oil and CO2 may chemically react to produce a modified crude oil that is now able to move more easily through the porous rock and toward oil production wells. In addition, water or steam injection is also commonly used to increase the oil pressure and/or improve oil viscosity to enhance production. Other methods of enhancing oil recovery includes heating the oil and making it less viscous, allowing it to flow out of the matrix and down into the fractures.

When oil production ceases after the secondary production, the wells may be further stimulated to afford tertiary recovery of the remaining oils. Tertiary recovery may involve injecting gases (such as carbon dioxide), or heat (steam or hot water) to stimulate oil and gas flow to produce remaining fluids that were not extracted during primary or secondary recovery phases.

During the third stage of hydrocarbon production, sophisticated techniques that alter the original properties of the oil may be used. Three major types of enhanced oil recovery (EOR) operations are in common use: (1) chemical flooding (alkaline flooding or micellar-polymer flooding), (2) miscible displacement (carbon dioxide ($CO_2$) injection or hydrocarbon injection), and (3) thermal recovery (steam flood or in situ combustion). The selection of any of these methods depends on reservoir temperature, pressure, depth, net pay, permeability, residual oil and water saturations, porosity and fluid properties such as oil API gravity and viscosity.

To enhance oil recovery, chemical and/or physical properties of hydrocarbons within a subterranean formation may need to be changed to allow hydrocarbon material to be more easily removed from the subterranean formation. The chemical and physical changes may be induced by in situ reactions that produce removable fluids, composition changes, solubility changes, phase changes, and/or viscosity changes of the hydrocarbons within the formation.

For example, in situ thermal combustion of hydrocarbons (often used for recovery of heavy oils and tars) for enhanced oil recovery has been known in the art. Such processes may use external movable heating elements to heat a formation zone in the wellbore to increase the mobility of hydrocarbons. U.S. Pat. No. 6,902,004 issued to de Rouffignac et al. discloses the use of movable heater elements to raise the temperatures in portions of the formation to pyrolysis temperature to gain access to desired hydrocarbon blends in situ. U.S. Pat. No. 6,991,033 issued to Wellington, et al. describes the use of an in situ thermal process in which both the heat applied and the pressure are carefully controlled.

Some in situ thermal processes may use catalysts in "flameless combustors" to generate heat in the wellbore. U.S. Pat. No. 5,899,269 issued to Wellington et al. describes the use of a flameless combustor which contains a chamber coated with a catalytic surface of palladium or platinum metal.

In situ combustion or heating of heavy oils and tars may also be used to provide a means of partially breaking down very large hydrocarbon sources into smaller manageable ones and/or to reduce viscosities and increase flow so that desirable hydrocarbon blends can be recovered at the well bore. In this approach, it is important that ignition and combustion temperatures are not so high that the amount of recoverable hydrocarbon is compromised. U.S. Pat. No. 6,918,442 issued to Wellington et al. describes an in situ thermal process in which a mixture of hydrogen, hydrocarbons and other fluids may be produced in a formation.

The conventional in situ combustive processes described above require relatively high temperatures to initiate the combustion reactions. This means external energy from the surface must be applied and costs of EOR processes are increased. It is, therefore, desirable to have methods that do not require external energy inputs from the surface to initiate or maintain the in situ combustion for EOR.

SUMMARY OF INVENTION

In one aspect, embodiments disclosed herein relate to methods for enhancing oil recovery in a formation. A method for enhancing oil recovery in accordance with one embodiment of the invention includes placing a catalyst in a wellbore; and introducing an oxidizing agent into the wellbore to contact the catalyst such that a hydrocarbon in the formation is oxidized to produce heat and at least one gas. The oxidizing agent may be air or oxygen. The catalyst may be one selected from platinum, palladium, rhodium, ruthenium, lead, manganese, nickel and metal oxides thereof. Further, the catalyst may be in the form of nanoparticles.

In another aspect, embodiments of the invention relate to systems for enhancing oil recovery in a reservoir formation. A system in accordance with one embodiment of the invention includes a catalyst arranged within a well adjacent the reservoir formation; and an oxidizing agent for engaging the catalyst, the oxidizing agent adapted to generate heat and at least one gas when engaging the catalyst and oxidizing a hydrocarbon. The oxidizing agent may be air or oxygen. The catalyst may be one selected from platinum, palladium, rhodium, ruthenium, lead, manganese, nickel and metal oxides thereof. Further, the catalyst may be in the form of nanoparticles.

Other aspects and advantages of the invention will become apparent from the following description and the attached claims.

BRIEF SUMMARY OF DRAWINGS

FIG. 1 shows a low temperature catalyzed processing of hydrocarbons in accordance with one embodiment of the invention.

DETAILED DESCRIPTION

Embodiments of the invention relate to methods for enhancing oil recovery based on downhole oxidation reactions. In accordance with embodiments of the invention, the downhole oxidation reactions are catalyzed such that these reactions can initiate downhole without external input of energy from the surface. In addition, these reactions, once initiated, may be maintained at controlled rates to supply heat and/or gas to enhanced oil recovery. In the following description, numerous details are set forth to provide an understanding of the present invention. However, it will be understood by those skilled in the art that the present invention may be practiced without these details and that numerous variations or modifications from the described embodiments may be possible.

As noted above heat and gas have been used to enhance oil recovery (EOR). However, in the conventional approach, the heat needed to enhance hydrocarbon flows are typically supplied from the surface, for example, by an electric heater disposed in the borehole. These processes are costly.

Embodiments of the invention use controlled, low temperature oxidative reactions to provide heat and/or gas for EOR. Embodiments of the invention allow the heat and/or gas generation from these reactions to be controllable such that oil recovery can be enhanced in a controlled manner.

Oxidation reactions (or combustion) typically require a relatively high initiation temperature. Therefore, external inputs of thermal energy are typically required to initiate the reaction. In accordance with embodiments of the invention, the initiation temperatures for the in situ combustion (oxidation) processes are relatively low. Therefore, no external input of thermal energy is required to initiate the reaction.

A typical combustion process can be summarized by the following chemical equation using an alkane (e.g., heptane) as an example:

$$C_7H_{16}+11O_2 \rightarrow 7CO_2+8H_2O+\text{heat}$$

A typical hydrocarbon combustion reaction produces a significant amount of "heat." However, such reactions will not start on its own due to relatively high activation energy barriers. When an external energy supplied is sufficient to overcome such barriers, the reaction will start and the heat generated in the process can provide the "initiation energy" needed for the subsequent reaction such that the combustion process, once started, can sustain itself.

In a non-catalyzed process, as shown above, the amount of external energy required to initiate the combustion is relatively high. This energy requirement for the initiation process may be lowered in the presence of a suitable catalyst. In accordance with embodiments of the invention, a catalyst may be judicially selected such that the initiation energy required for the combustion reaction may be very small such that under the downhole conditions (which may have a temperature as high as 300° F. or 150° C.), no input of external energy from the surface is required, i.e., the reactions become spontaneous. In addition, such catalyzed reactions would be able to sustain themselves without continued input of external energy from the surface.

Catalysts for oxidation reactions may comprise a wide array of chemical compositions that allow reaction with air or oxygen pumped downhole. In accordance with embodiments of the invention, suitable catalysts may include oxygen-reactive metals or metal compounds, such as platinum, palladium, rhodium, ruthenium, lead, manganese, nickel and metal oxides of these metals. These catalysts, when combined with an appropriate fuel/air mixture (and probably a small amount of heat), can cause ignition and sustain subsequent combustion. In accordance with embodiments of the invention, the hydrocarbons in the formation provide fuels for such combustion. The rates of such combustions may be controlled by the rate of introduction of the oxidizing agent (e.g., air or oxygen) into the formation, and/or by controlling the particle sizes and/or the shapes of the catalyst particles.

In accordance with some embodiments of the invention, such catalysts may not necessarily catalyze complete combustions of the hydrocarbons (or other fuel). Instead, the catalysts may facilitate partial breakdown of the hydrocarbons to afford partial combustion products. This can be an important aspect in the recovery of heavy hydrocarbons because high ignition temperatures often result in low recovery of useful products due to the high degree of combustion (formation of large amounts of $CO_2$ and other non-condensable hydrocarbons). Useful recoverable hydrocarbons are those products that still contain large amounts of energy (long hydrocarbon chains). An example of partial combustion of a large hydrocarbon is shown in the following equation:

$$C_{20}H_{42}+O_2 \rightarrow 2C_{10}H_{20}+2H_2O$$

This example shows the scission of a $C_{20}$ hydrocarbon into two equal hydrocarbon products in a partial oxidation reaction. In a typical combustion process, however, mixtures of partial oxidation products of differing chain lengths (and even some complete oxidation to $CO_2$) are likely produced. For the purpose of enhanced oil recovery, it would be optimal to maximize higher molecular weight oils that are transportable to the wellbore and are condensable. In this respect, the physical properties of the hydrocarbons, such as boiling point, viscosity and density, are important to consider. In accordance with embodiments of the invention, the ratio of hydrocarbon to oxygen, as shown in the above equation, may be controlled to produce the desired partial reaction products.

In addition, the sizes and shapes of the catalysts may be selected as means to control the rates of the reactions, and hence the heat and quantity of gases produced. One of ordinary skill in the art would appreciate that the greater the surface area of a given amount of catalyst, the more efficient the catalysis. In accordance with embodiments of the invention, certain catalyst compositions and structure/morphology may be selected to permit near room temperature combustion, while other size and structure/morphology combinations may be selected to sustain combustion at desired temperatures (e.g., over 200° F.). Catalysts in accordance with embodiments of the invention may be formed under controlled conditions, as known in the art, to provide various sizes and shapes.

In this regard, catalyst particles on the nanometer scale are particularly suited for controlling in situ hydrocarbon combustion downhole at lower temperatures. For example, such nanoparticles may be as small as 5-10 nanometers in diameter, or as large as 500 nanometers in diameter or larger. The nanoparticle catalysts have very high specific surface areas (i.e., surface areas per unit weight) that will make them very efficient. In addition, these nanoparticle catalysts may permit their use at greatly reduced loadings.

The use of nanoparticle catalysts have been demonstrated in laboratory settings. See e.g., Hu et al., "*Nano-catalytic spontaneous ignition and self-supporting room-temperature combustion*," Energy and Fuels, 855 (2005). This paper discloses stable and reproducible spontaneous self-ignition and self-supporting combustion at room temperature by exposing nanometer-sized catalytic particles to methanol/air or ethanol/air gas mixtures. Without any external energy input, platinum nanoparticles supported on glass wools can catalyze instantaneously combustion of the gas mixtures. The reaction releases heat and produces $CO_2$ and water. Furthermore, such reactions may be controlled to produce reaction temperatures as high as 600 degrees C. and as low as a few tenths of a degree above room temperature. The reaction rate is controlled by varying the fuel/air mixture. In addition, catalytic activity could be controlled by changing particle sizes and/or particle morphology.

Embodiments of the invention provide methods for using a low temperature combustion (oxidation) reaction to enhance oil recovery. In accordance with embodiments of the invention, a suitable catalyst may be placed in a wellbore and an oxidizing agent (e.g., air, oxygen) is pumped downhole to start and maintain a combustion, which will provide heat and gases for EOR. The catalysts may be of controlled sizes, including nanoparticles, to provide the desired reaction rates. The catalysts may be introduced downhole by suspending them in a fluid or included in other fluids, such as a stimulation or workover fluid, and pumped into wellbore and/or formations fractures. Similarly, the oxidizing agents may be pumped in a fluid alone or mixed in other well fluids.

In accordance with some embodiments of the invention, the catalysts may also be immobilized on a particulate support, such as proppants, commonly used with well fluids, before they are pumped downhole. In addition, catalysts of the invention may also be immobilized on other supports, such as alumina, silica, or ceramic. Inclusion of the catalyst on a support material may aid in the recovery and recycling of the catalyst for further use.

FIG. 1 illustrates one method of the invention. The catalyst may be introduced into the well bore 1 supported on appropriate proppants 5. Introducing the catalysts into the fissures 3 as catalyst doped proppants 5 and introduction of oxygen would allow spontaneous ignition (i.e., without external energy provided from the surface) and controlled combustion of hydrocarbons downhole. Such initiation and ensuing combustion may occur at temperatures far below conventional in situ thermal hydrocarbon processing, which rely on heat source provided from the surface.

Advantages of embodiments of the invention may include one or more of the following. Use of the described catalysts downhole allow oxidation temperatures lower than conventional thermal oxidative combustion. The control exerted by the catalyzed combustion process allows for the selective extraction of desirable hydrocarbon blends. Having the catalyst downhole obviates the need for awkward heating elements that require high ignition temperatures and result in high temperatures of combustion limiting the types of recoverable hydrocarbon. Since the reactions occur at relatively low temperatures, a significant portion of the products may be condensable hydrocarbons that have a high energy content.

While the invention has been described with respect to a limited number of embodiments, those skilled in the art, having the benefit of this disclosure, will appreciate that other embodiments can be devised which do not depart from the scope of the invention as disclosed herein. Accordingly, the scope of the invention should be limited only by the attached claims.

What is claimed is:

1. A method for enhancing oil recovery in a formation, comprising:

placing a metal or metal oxide catalyst in a wellbore, wherein the metal or metal oxide catalyst comprises nanoparticles having diameters less than about 1 micrometer; and introducing an oxidizing agent into the wellbore to contact the metal or metal oxide catalyst such that a hydrocarbon in the formation is oxidized to produce heat and at least one gas.

2. The method of claim 1, wherein the oxidizing agent is selected from the group consisting of air and oxygen.

3. The method of claim 1, wherein the diameters are 5-500 nanometers.

4. The method of claim 1, wherein the metal or metal oxide catalyst is at least one selected from the group consisting of platinum, palladium, rhodium, ruthenium, lead, manganese, nickel and metal oxides thereof.

5. The method of claim 1, wherein the placement of the metal or metal oxide catalyst comprises dispersing The metal or metal oxide catalyst in a well fluid and pumping the well fluid downhole.

6. The method of claim 5, wherein the well fluid is a stimulation fluid.

7. The method of claim 1, wherein the metal or metal oxide catalyst is immobilized on a support.

8. The method of claim 7, wherein the support is a proppant.

9. The method of claim 7, wherein the support is at least one selected from the group consisting of aluminum, silica, and ceramic.

10. A system for enhancing oil recovery in a reservoir formation, comprising:

a metal or metal oxide catalyst arranged within a well adjacent the reservoir formation, wherein the metal or metal oxide catalyst comprises nanoparticles having diameters less than about 1 micrometer; and an oxidizing agent for engaging the metal or metal oxide catalyst, the oxidizing agent adapted to generate heat and at least one gas when engaging the metal or metal oxide catalyst and oxidizing a hydrocarbon.

11. The system of claim 10, wherein the oxidizing agent is selected from the group consisting of air and oxygen.

12. The system of claim 10, wherein the diameters are 5-500 nanometers.

13. The system of claim 10, wherein the metal or metal oxide catalyst is at least one selected from the group consisting of platinum, palladium, rhodium, ruthenium, lead, manganese, nickel and metal oxides thereof.

14. The system of claim 10, wherein the metal or metal oxide catalyst are arranged in the well by dispersing the metal or metal oxide catalyst in a well fluid and pumping the well fluid downhole.

15. The system of claim 14, wherein the well fluid is a stimulation fluid.

16. The system of claim 10, wherein the metal or metal oxide catalyst is immobilized on a support.

17. The system of claim 16, wherein the support is a proppant.

18. The system of claim 16, wherein the support is at least one selected from the group consisting of aluminum, silica, and ceramic.

* * * * *